US012590498B1

(12) United States Patent
Arabie et al.

(10) Patent No.: US 12,590,498 B1
(45) Date of Patent: Mar. 31, 2026

(54) METHOD AND APPARATUS FOR DOWNHOLE FLUID FILL-UP

(71) Applicant: Oilfield Service Professionals, Inc., Houston, TX (US)

(72) Inventors: Blake Arabie, Rayne, LA (US); Scotty Verret, Carencro, LA (US)

(73) Assignee: OILFIELD SERVICE PROFESSIONALS, INC., Lafayette, LA (US)

( * ) Notice: Subject to any disclaimer, the term of this patent is extended or adjusted under 35 U.S.C. 154(b) by 0 days.

(21) Appl. No.: 19/083,735

(22) Filed: Mar. 19, 2025

Related U.S. Application Data

(60) Provisional application No. 63/567,504, filed on Mar. 20, 2024.

(51) Int. Cl.
*E21B 34/14* (2006.01)
*E21B 23/04* (2006.01)
*E21B 34/10* (2006.01)

(52) U.S. Cl.
CPC ..... *E21B 23/042* (2020.05); *E21B 34/103* (2013.01); *E21B 2200/06* (2020.05)

(58) Field of Classification Search
CPC ..... E21B 34/10; E21B 34/103; E21B 34/14; E21B 34/142; E21B 34/063; E21B 21/08; E21B 23/0412; E21B 34/0413; E21B 23/042; E21B 2200/06
See application file for complete search history.

(56) References Cited

U.S. PATENT DOCUMENTS

| | | | | |
|---|---|---|---|---|
| 4,044,829 | A * | 8/1977 | Jessup | E21B 49/087 166/264 |
| 4,324,293 | A * | 4/1982 | Hushbeck | E21B 49/001 166/324 |
| 4,693,314 | A * | 9/1987 | Wesson | E21B 34/103 166/373 |
| 10,087,712 | B2 * | 10/2018 | Kennedy | E21B 34/14 |
| 10,190,397 | B2 * | 1/2019 | Budde | E21B 43/10 |

* cited by examiner

*Primary Examiner* — Kenneth L Thompson
(74) *Attorney, Agent, or Firm* — Ted M. Anthony

(57) ABSTRACT

A downhole fill-up tool for use in oilfield operations, comprising a housing with a shear closing feature. The tool includes a pressure-actuated piston that triggers the shearing action, ensuring proper sealing and containment of wellbore fluids. The design of the tool allows for safe and efficient fill-up operations in challenging downhole wellbore environments.

12 Claims, 5 Drawing Sheets

METHOD AND APPARATUS FOR DOWNHOLE FLUID FILL-UP

CROSS REFERENCES TO RELATED APPLICATION

THIS APPLICATION CLAIMS PRIORITY OF U.S. PROVISIONAL PATENT APPLICATION Ser. No. 63/567,504, FILED Mar. 20, 2024, WHICH IS INCORPORATED BY REFERENCE HEREIN FOR ALL PURPOSES

STATEMENTS AS TO THE RIGHTS TO THE INVENTION MADE UNDER FEDERALLY SPONSORED RESEARCH AND DEVELOPMENT

NONE

BACKGROUND OF THE INVENTION

1. Field of the Invention

The present invention pertains to a downhole fluid fill-up apparatus. More particularly, the present invention pertains to a downhole fluid fill-up apparatus that can be selectively shifted between a first open position (wherein transverse fluid flow ports are open and unobstructed, thereby allowing a workstring to fill with wellbore fluids) to a second closed position (wherein said transverse flow ports are fully closed and obstructed).

2. Brief Description of the Prior Art

Oil and/or gas wells are typically formed by drilling an initial wellbore that extends into the earth's crust and penetrates subterranean formations. Downhole operations can be performed in such a wellbore using tools and/or other bottom hole assemblies that are conveyed into said wellbore from the surface on a tubular workstring. Such tubular workstrings (which can be drill pipe, tubing or other tubular goods) typically comprise individual sections or segments known as "joints" that are assembled together on a drilling rig in end-to-end relationship. The pipe sections are typically joined using mating threaded connections in order to form a continuous pipe string having a desired length.

Drilling mud or other drilling fluid is typically pumped into the central through bore of a tubular workstring at a surface drilling rig, and out the distal end of the tubular workstring or attached bottom hole assembly. Such drilling mud or other fluid is then typically circulated back to the surface in the annular space formed between the outer surface of the drill pipe string and the inner surface of the bore hole and/or any casing strings or liners installed in said bore hole. As a result, a wellbore extending into subterranean formations is typically filled with such drilling fluid.

When a downhole tool or other bottom hole assembly is conveyed into a wellbore from the earth's surface via a tubular workstring, the distal or lower end of the pipe string may be blocked or closed; as a result, drilling fluid within a wellbore can be prevented from entering the inner bore of said tubular workstring unless there is at least one flow port to permit fluid communication between the surrounding wellbore (or, more specifically, the annular space formed around the external surface of the workstring) and the inner bore of the workstring. Although permanently-open flow ports in a bottom hole assembly will permit fluid from a wellbore to enter the inner pipe bore, such permanently-open flow ports can negatively affect certain downhole operations and, therefore, such permanently-open flow ports are frequently undesirable in many circumstances.

In such cases, when there is no such fluid port(s) permitting fluid communication between the internal bore of the workstring and the surrounding wellbore, it is common practice to fill up the inner bore of the workstring with drilling fluid at the surface as the pipe sections are joined together and lowered into a wellbore from a drilling rig. However, such surface fluid fill-up operations can be time consuming and labor-intensive, which typically results in significant expense during drilling rig operations.

Conventional fluid fill-up tools have been developed to address this issue. However, such conventional fill-up tools are frequently unreliable and prone to operational failure, particularly during actuation. When such failure occurs, conventional fill-up tools generally must be retrieved from a wellbore, resulting in additional cost, delay and operational risk. Thus, there is a need for a downhole fill-up tool having an actuation feature that is reliable and permits repeated cycling of selective opening and closing of fill-up ports.

SUMMARY OF THE INVENTION

The present invention comprises a downhole fill-up apparatus having a spring-assist closing feature. In a preferred embodiment, said downhole fill-up apparatus comprises a housing having a central through bore and field configurable fluid flow ports. An inner sliding sleeve is movably disposed in said central through bore of said housing. A pressure-actuated piston, a bias spring, and a field configurable shearing mechanism are also provided.

The downhole fill-up apparatus of the present invention can be selectively installed at one or more locations within a tubular workstring such as, for example, in proximity to a downhole tool or bottom hole assembly. In this configuration, said fluid flow ports can be open, thereby permitting drilling mud and/or other wellbore fluids to enter into the central bore of a tubular workstring as said downhole fill-up apparatus is submerged and lowered into a fluid-filled wellbore.

The housing is configured to withstand high fluid pressure and temperature conditions commonly encountered in downhole operations in oil and gas wellbores. At least one transverse flow port extends through said housing to permit fluid communication between the central through bore and the external surface of said housing. The sliding sleeve is moveably disposed within a central through bore of said housing and can move axially along a path that is parallel to the longitudinal axis of said central through bore. The pressure-actuated piston, which is operationally attached to said sliding sleeve, is movably disposed within a fluid chamber.

As the downhole fill-up apparatus is lowered deeper into a subterranean wellbore, surrounding fluid pressure increases. When the pressure differential between said downhole fluid pressure and a pre-loaded pressurized chamber reaches a predetermined value, one or more shear-able elements (having a predetermined shear force) of said field configurable shearing mechanism separate, thereby allowing said sliding sleeve to shift and block said at least one transverse fluid flow ports.

In a preferred embodiment, said field configurable flow ports and shearing mechanism can be selectively adjusted to account for different anticipated wellbore conditions and fluid parameters. Put another way, when the downhole fill-up apparatus is deployed into a wellbore, the pressure-actuated piston is activated by a pressure differential acting on said piston based upon predetermined parameters such as fluid characteristics and depth.

After this predetermined pressure differential is achieved, the resultant force acting on said pressure actuated piston and sliding sleeve cause said shear-able element(s) to separate. When this occurs, the sliding sleeve shifts positions, effectively closing and sealing off the port(s) and isolating the well fluids within the inner bore of the workstring from those outside said workstring.

In the event that the primary closing feature does not actuate as desired, a secondary closing feature is provided. Said secondary closing feature ensures workstring fluid seal integrity should the primary shearing mechanism fail to perform for any reason. Additionally, a tertiary sealing mechanism can also selectively block said transverse flow ports of the system, especially in the event the primary and/or secondary closing feature fails to properly function. In a preferred embodiment, said tertiary sealing mechanism can comprise a droppable dart with sealing fins and a rupture disk.

The fill-up apparatus of the present invention allows for a redundant, reliable, and controlled method for selectively sealing the inner bore of a tubular workstring when desired, while also reducing the risk of unwanted fluid loss and contamination. Additionally, the fill-up apparatus of the present invention is designed to withstand harsh downhole conditions, ensuring long-term durability and performance.

BRIEF DESCRIPTION OF THE DRAWINGS

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
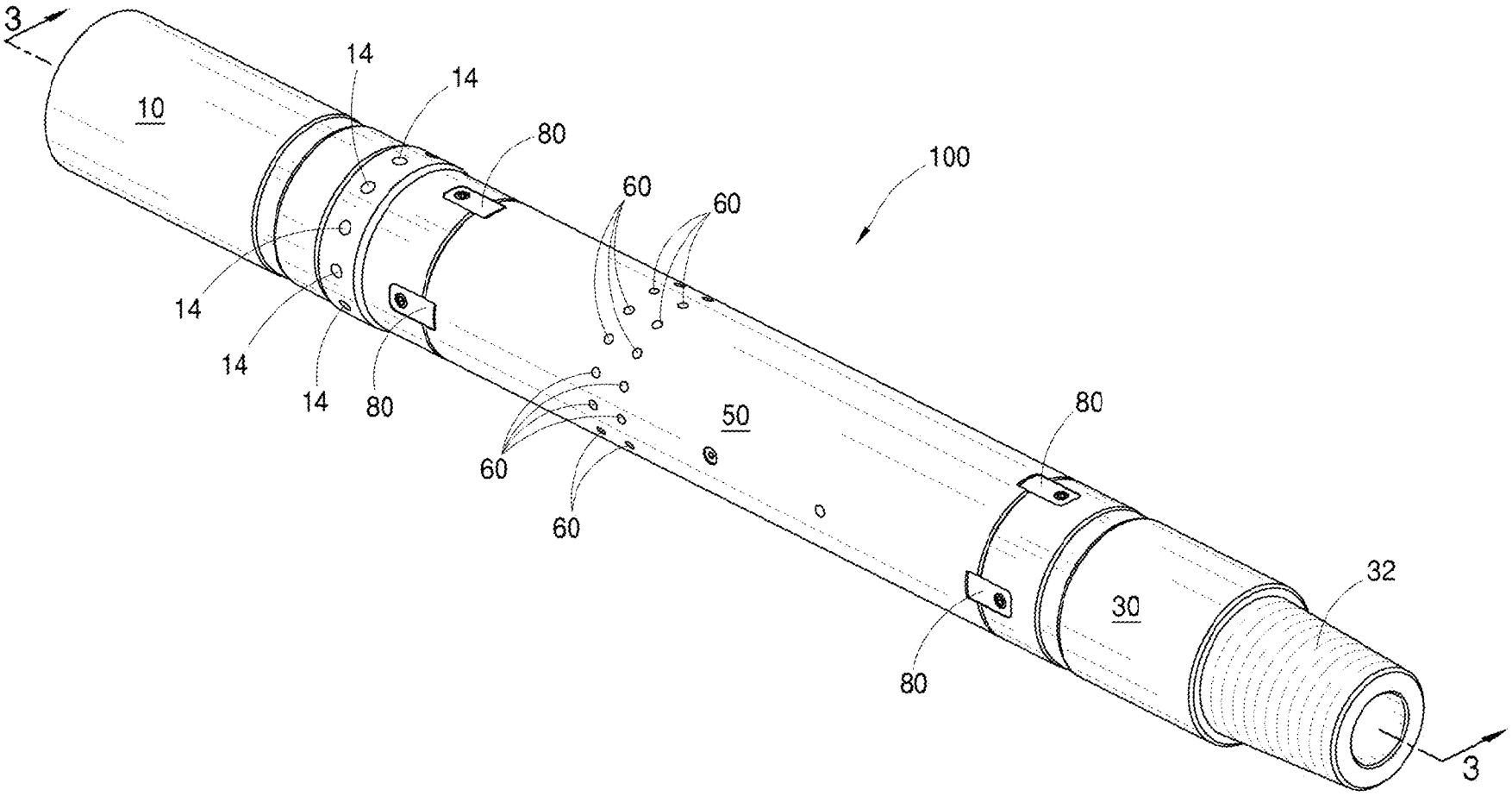
FIG. 1 depicts a side perspective view of the downhole fluid fill-up apparatus of the present invention.

Before describing various embodiments of the present disclosure in further detail by way of exemplary description, examples, and results, it is to be understood that the apparatus and methods of the present disclosure are not limited in application to the details of specific embodiments and examples as set forth in the following description. The description provided herein is intended for purposes of illustration only and is not intended to be construed in a limiting sense. As such, the language used herein is intended to be given the broadest possible scope and meaning, and the embodiments and examples are meant to be exemplary, not exhaustive. Also, it is to be understood that the phraseology and terminology employed herein is for the purpose of description only and should not be regarded as limiting unless otherwise indicated as so. Moreover, in the following detailed description, numerous specific details are set forth in order to provide a more thorough understanding of the present disclosure.

It will be apparent to a person having ordinary skill in the art that the present disclosure may be practiced without these specific details. In other instances, features which are well known to persons of ordinary skill in the art have not been described in detail to avoid unnecessary complication of the description. It is intended that all alternatives, substitutions, modifications, and equivalents apparent to those having ordinary skill in the art are included within the scope of the present disclosure.

Thus, while the apparatus and methods of the present disclosure have been described in terms of particular embodiments, it will be apparent to those of skill in the art that variations may be applied to the apparatus and methods and the steps or in the sequence of steps of the methods described herein without departing from the concept, spirit, and scope of the inventive concepts. Referring to the drawings, like numerals indicate like or corresponding parts throughout the several views.

Moreover, it will be understood that various directions such as "upper", "lower", "bottom", "top", "left", "right", and so forth are made only with respect to explanation in conjunction with the drawings, and dimensions and material selections set forth herein and in the appended drawings are exemplary only. As a result, components may be oriented differently, for instance, during transportation and manufacturing as well as operation, may have different dimensions, and may be made of different material(s) having satisfactory characteristics. Because many varying and different embodiments may be made within the scope of the concept(s) herein taught, and because many modifications may be made in the embodiments described herein, it is to be understood that the details herein are to be interpreted as illustrative and non-limiting.

FIG. 1 depicts a side perspective view of downhole fluid fill-up apparatus 100 of the present invention. In a preferred embodiment, said downhole fluid fill-up apparatus 10 as depicted in FIG. 1 comprises upper connection member 10, central body member 50 and lower connection member 30 having lower external threads 32. Anti-rotation lugs 80 are disposed between said upper connection member 10 and central body member 50, as well as between said central body member 50 and said lower connection member 30. A plurality of transverse flow ports 14 are arranged in spaced relationship around the circumference of upper connection member 10 and extend through said upper connection member 10. A plurality of shear pins 60 are received in bores in said central body member 50. Downhole fill-up apparatus 100 of the present invention can be selectively installed at one or more locations along the length of a tubular workstring such as, for example, in proximity to a downhole tool or bottom hole assembly.

Figure 2:
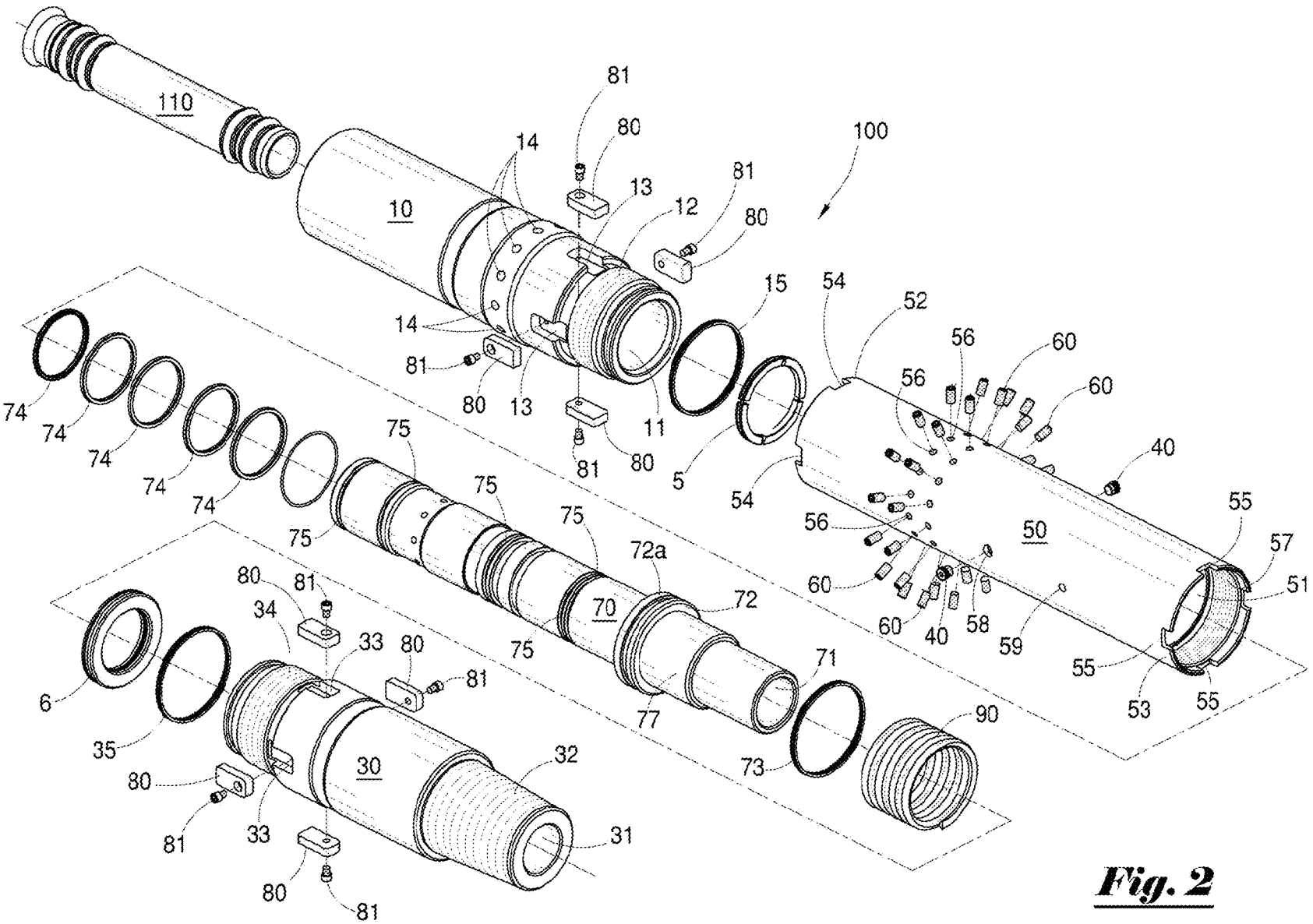
FIG. 2 depicts a side perspective and exploded view of the downhole fluid fill-up apparatus of the present invention.

FIG. 2 depicts a side perspective and exploded view of downhole fluid fill-up apparatus 100 of the present invention. Upper connection member 10 has central through bore 11 and threaded section 12; in a preferred embodiment, said threaded section 12 comprises a male or "pin-end" threaded connection member. Elastomeric sealing member 15, which can be an O-ring or other sealing member, can be received on said threaded section 12. A plurality of lug recesses 13 are disposed in spaced relationship around the circumference of upper connection member 10. Lug recesses 13 are configured to receive anti-rotation lugs 80, which can be secured in place using set screws 81. A plurality of transverse flow ports 14 are arranged in spaced relationship around the circumference of upper connection member 10 and extend through said upper connection member 10 into central through bore 11.

Central body member 50 has first end 52 and second end 53, as well as central through bore 51 and internally threaded section 57. In a preferred embodiment, said internally threaded section 57 comprises a female or "box-end" threaded connection member. A plurality of lug recesses 54 are disposed in spaced relationship around the circumference of central body member 50 at first end 52; said lug recesses 54 are configured to align with lug recesses 13 of upper connection member 10 and partially receive installed anti-rotation lugs 80. Similarly, a plurality of lug recesses 55 are disposed in spaced relationship around the circumference of central body member 50 at second end 53; said lug recesses 55 are configured to align with lug recesses 33 of lower connection member 30 and partially receive installed anti-rotation lugs 80.

A plurality of transverse bores 56 are arranged in spaced-relationship around (and extend through) central body member 50, and are configured to receive shear pins 60. Wear ring 5 is received within central through bore 51 of said central body member 50. At least one communication port 59 also extends through said central body member 50 and into central through bore 51. At least one communication port 58 also extends through said central body member 50 into central through bore 51, while a threaded plug 40 can be threadedly received within each of said at least one communication port 58.

Lower connection member 30 has central through bore 31 and threaded sections 32 and 34. In a preferred embodiment, said threaded sections 32 and 34 both comprise male or "pin-end" threaded connection members. A plurality of lug recesses 33 are disposed in spaced relationship around the circumference of lower connection member 30; said lug recesses 33 are configured to align with lug recesses 55 of central body member 50. Lug recesses 33 are configured to partially receive anti-rotation lugs 80, which can be secured in place using set screws 81. Elastomeric sealing member 35, which can be an O-ring or other sealing member, can be received on threaded section 34. Floating piston ring 6 is received within central through bore 31 of lower connection member 30.

Still referring to FIG. 2, sliding sleeve member 70 having central through bore 71 is moveably disposed within aligned central through bore 51 of central body member 50 and central through bore 11 of upper connection member 10. Fluid piston member 72 extends from the outer surface of said sliding sleeve member 70. Elastomeric sealing member 73, which can be an O-ring or other sealing member, can be received in groove 72*a* of fluid piston member 72. Additionally, elastomeric O-rings 74 can be received within grooves 75 extending around the outer surface of sliding sleeve member 70.

Figure 3:
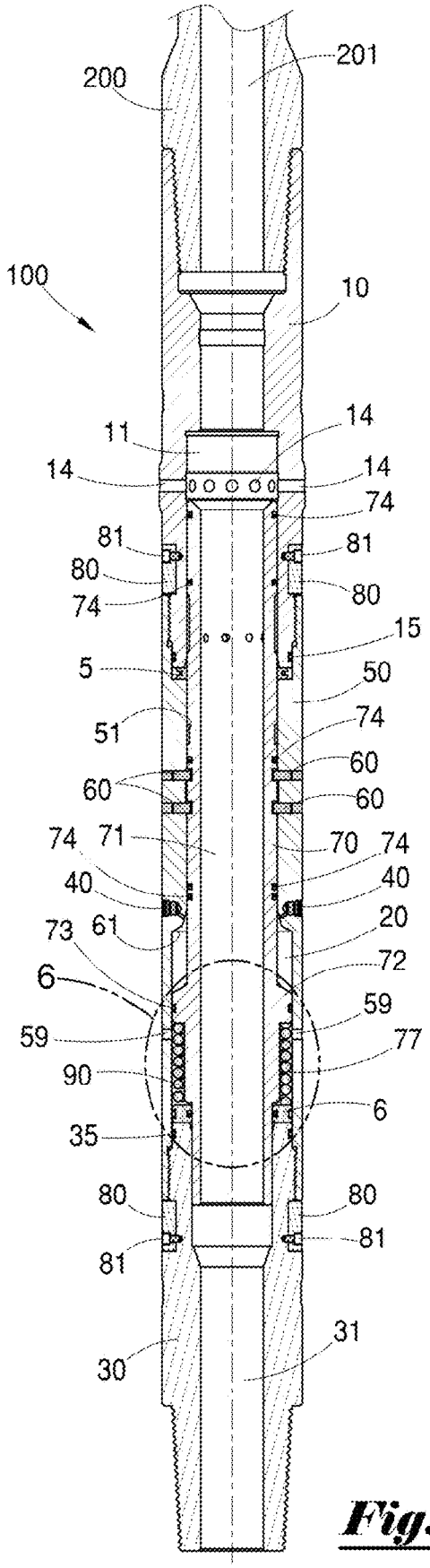
FIG. 3 depicts a side sectional view of the downhole fluid fill-up apparatus of the present invention, along line 3-3 of FIG. 1, in a first position.

Spring 90 is received over nose extension 77 of sliding sleeve member 70. In a preferred embodiment, said spring 90 comprises a coil compression spring. However, it is to be observed that other type(s) of bias spring can be utilized without departing from the scope of the invention. Droppable dart 110 is configured to be selectively received within central through bore 11 of upper connection member 10. However, it is to be understood that fluid fill-up apparatus 100 can be operated without use of droppable dart 110 unless use of said droppable dart 110 becomes necessary of desirable as more fully described below FIG. 3 depicts a side sectional view of the downhole fluid fill-up apparatus 100 of the present invention, along line 3-3 of FIG. 1. In the configuration depicted in FIG. 3, said downhole fluid fill-up apparatus 100 is in a first open or "run-in-hole" configuration. Upper connection member 10 and lower connection member 30 are operationally attached to central body member 50. Through bore 11 of upper connection member, through bore 51 of central body member 50, and through bore 31 of lower connection member are oriented in axial alignment. Anti-rotation lugs 80 are secured in place using set screws 81 and prevent rotation of said upper connection member 10 relative to central body member 50, as well as rotation of lower connection member 30 relative to said central body member 50. A plurality of transverse flow ports 14 extend through said upper connection member 10 into central through bore 11.

Sliding sleeve member 70 having central through bore 71 is moveably disposed within central through bore 51 of central body member 50 and aligned central through bore 11 of upper connection member 10. Fluid piston member 72 extends from the outer surface of said sliding sleeve member 70. Spring 90 is received over nose extension 77 of sliding sleeve member 70 and, in the configuration depicted in FIG. 3, is compressed between said fluid piston member 72 and floating piston ring 6.

Still referring to FIG. 3, at least one shear pin 60 extends through central body member 70 to secure sliding sleeve member 70 against axial movement within aligned bores 11 and 51. Fluid chamber 20 is formed between the inner surface of central through bore 51 of central body member 50 and the outer surface of sliding sleeve 70, and extends from fluid piston 72 of sliding sleeve 70 to internal shoulder 61 of central body member 50. Prior to installation of downhole fluid fill-up apparatus 100 into a wellbore, gas (typically air which is at ambient atmospheric pressure) is permitted to fill said fluid chamber 20 through ports 58 and is trapped in place by installation of threaded plugs 40.

With sliding sleeve 70 in the open position depicted in FIG. 3, sliding sleeve 70 is positioned so that transverse flow ports 14 are not obstructed or blocked by said sliding sleeve 70. Put another way, said flow ports 14 are exposed and fully open. In this position, wellbore fluids can flow through said ports 14 into the central through bore 11 of upper connection member 10 (and central through bore 71 of sliding sleeve 70 and central through bore 31 of lower connection member 30), as well as the flow bore 201 of any attached workstring 200 or other tubular string attached to upper connection member 10 of said downhole fill-up apparatus 100.

Figure 6:
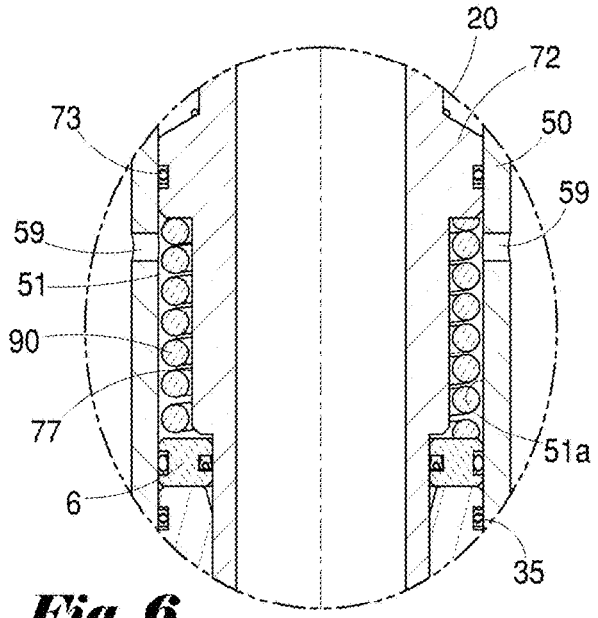
FIG. 6 depicts a detailed view of the highlighted area depicted in FIG. 3.

FIG. 6 depicts a detailed view of the highlighted area (labeled 6) depicted in FIG. 3. Referring to FIG. 6, when downhole fill-up apparatus 100 is deployed into a wellbore, hydrostatic pressure within a wellbore is communicated below fluid piston member 72 through central body member 50 via communication ports 59. Elastomeric sealing member 73, which can be an O-ring or other sealing member, is disposed on said fluid piston member 72 (which is operationally attached to sliding sleeve 70) and forms a fluid pressure seal against inner surface 51*a* of central through bore 51 of central body member 50.

As said downhole fill-up apparatus 100 is lowered deeper into a wellbore, said hydrostatic pressure observed by said downhole fill-up apparatus 100 increases with depth. Eventually the hydrostatic fluid pressure observed through communication ports 59 exceeds atmospheric pressure trapped within fluid chamber 20. As such, a pressure differential is formed across fluid piston member 72; hydrostatic pressure (via communication ports 59) is communicated to one side of fluid piston member 72, while trapped atmospheric pressure (in fluid chamber 20) is observed on the other side of said fluid piston member 72.

The hydrostatic fluid pressure communicated via communication ports 59, which eventually exceeds the trapped atmospheric pressure in fluid chamber 20, acts on fluid piston member 72 and attached sliding sleeve 70. Referring back to FIG. 3, when said force acting on said sliding sleeve 70 reaches a predetermined force value, said at least one shear pin 60 shears, thereby "unlocking" said sliding sleeve 70 and permitting sliding sleeve 70 to travel within central through bore 51 of central body member 50. It is to be observed that at least one shear pin 60—and the amount of force required to shear said at least one pin 60—can be selectively set or changed, both in the field or at a wellsite or in another remote location, in order to adjust the amount of pressure differential required to shear said at least one pin 60 and trigger movement of sliding sleeve 70.

Figure 4:
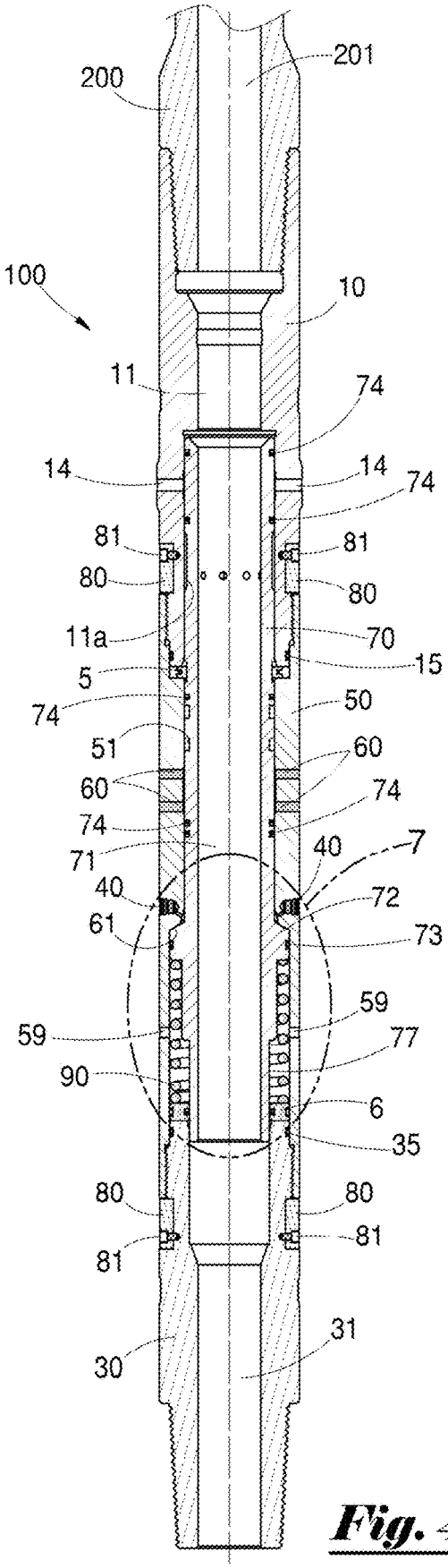
FIG. 4 depicts a side sectional view of the downhole fluid fill-up apparatus depicted in FIG. 3 in a second position.

FIG. 4 depicts a side sectional view of downhole fluid fill-up apparatus 100 depicted in FIG. 3 in a second "closed" position After said at least one shear pin 60 is sheared, hydrostatic pressure observed through communication ports 59 acting on fluid piston member 72, aided by bias force from spring 90, causes said fluid piston 72 to compress air (or other gas) trapped within fluid chamber 20. Said sliding sleeve 70 shift positions from a first open position (wherein transverse ports 14 are unobstructed) to a second closed position (wherein transverse ports are blocked). In this configuration, sealing elements 74 are positioned on both sides of transverse ports 14, and engage against inner surface 11*a* of central through bore 11 of upper connection member 10 and inner surface 51*a* of central through bore 51 of central body member 50, to form a fluid pressure seal, while sliding sleeve 70 fully blocks or obstructs transverse ports 14.

Figure 7:
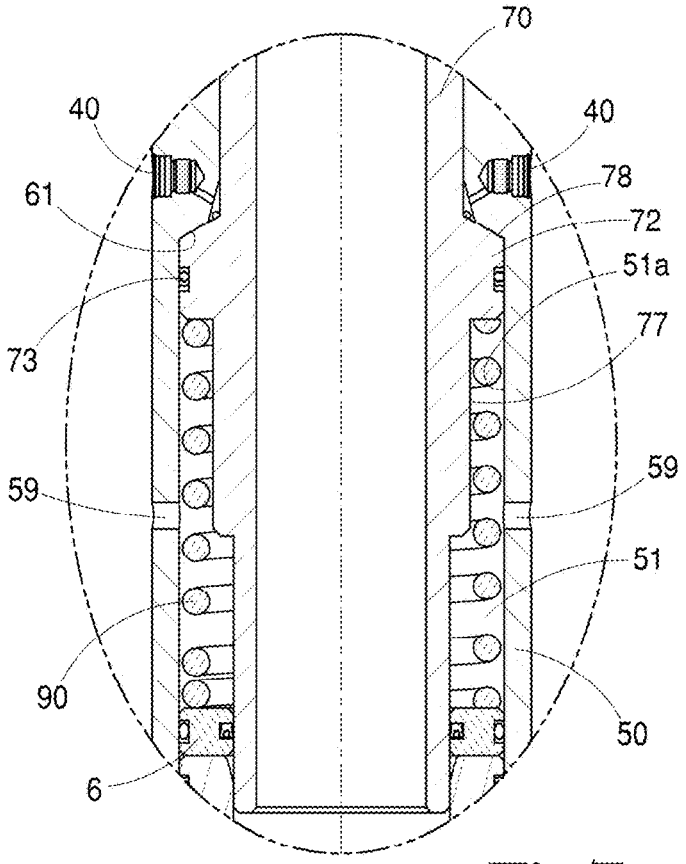
FIG. 7 depicts a detailed view of the highlighted area depicted in FIG. 4.

FIG. 7 depicts a detailed view of the highlighted area (labeled 7) depicted in FIG. 4. Referring to FIG. 7, shifting of said sliding sleeve 70 is further aided by force provided by bias spring 90. Said sliding sleeve 70 shifts until upper shoulder 78 of fluid piston 72 contacts and engages against opposing shoulder 61 formed within central through bore 51 of central body member 50. Further, said sliding sleeve 70 remains in the closed position until and unless it is again shifted in the opposite direction as described herein.

Referring back to FIG. 4, after shifting, sliding sleeve 70 blocks and fully obstructs transverse flow ports 14. As a result, well fluids are isolated within the inner bore 201 of a workstring 200 (from those fluids in wellbore annular space outside of said workstring 200). In this position, an open central passageway exists through said downhole fluid fill-up apparatus 100; as such, an actuation ball or other object can pass through said open passageway of said fluid fill-up apparatus and seat in a bottom hole assembly (not pictured) in a manner that is well known to those having skill in the art. Thereafter, with said central through bore blocked, fluid pressure can be applied through the central through bore of workstring 200 without said fluid pressure leaking through flow ports 14 (which are blocked in this configuration).

Referring back to FIG. 3, in the event that sliding sleeve 70 does not fully shift for any reason and does not block or obstruct transverse flow ports 14, drilling fluid can be pumped from the surface down central through bore 201 of workstring 200 and into central bore 11 of upper connection member 10. Said pumped fluid exits said transverse flow ports 14 into the wellbore area surrounding downhole fluid fill-up apparatus 100; increased fluid pressure (over and above existing hydrostatic pressure) is observed via communication ports 59. Such increased fluid pressure acts upon fluid piston member 72 and floating piston ring 6 in order further force sliding sleeve 70 to shift into a second closed position, thereby serving as a secondary or "back-up" actuation means.

Figure 8:
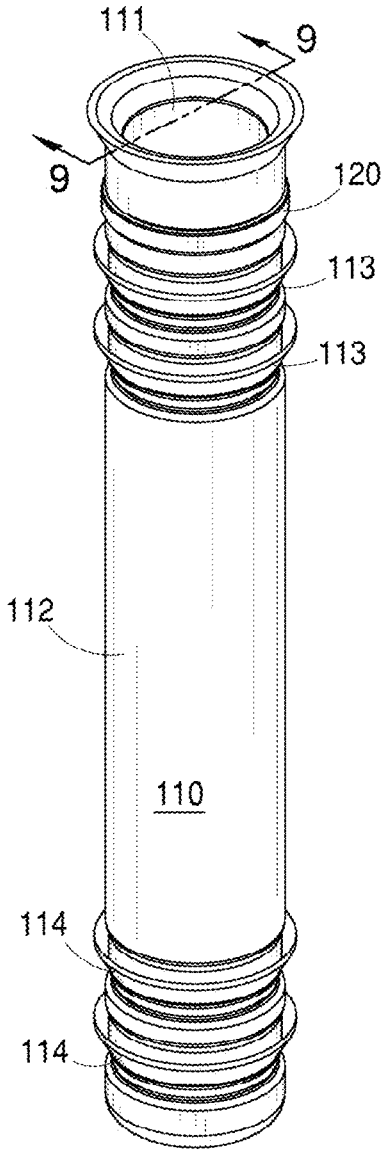
FIG. 8 depicts a side perspective view of a droppable dart of the present invention.
Figure 9:
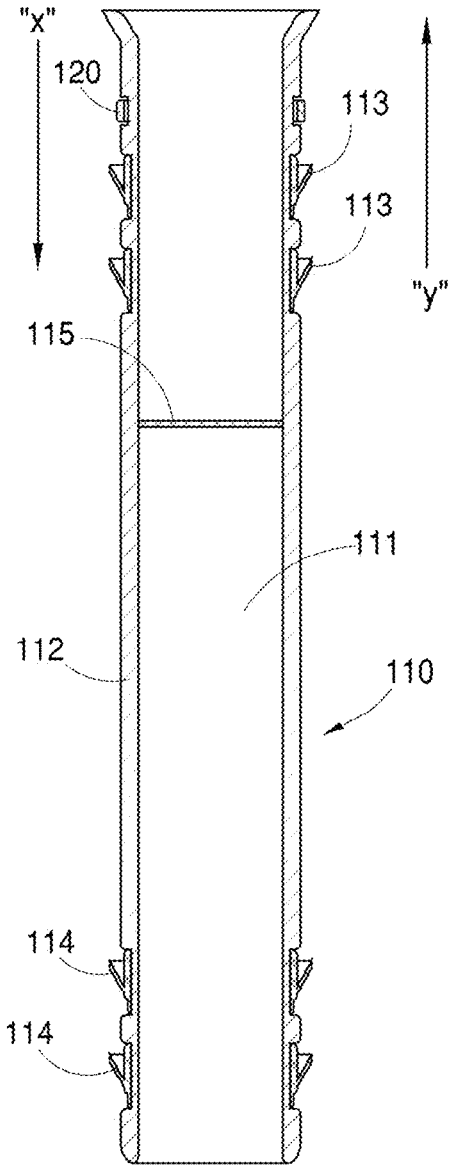
FIG. 9 depicts a side sectional view of a droppable dart of the present invention along line 9-9 of FIG. 8.

FIG. 8 depicts a side perspective view of a droppable dart 110 of the present invention, while FIG. 9 depicts a side sectional view of a droppable dart 110 of the present invention along line 9-9 of FIG. 8. In a preferred embodiment, said droppable dart 110 comprises a substantially cylindrical member having central body section 112 and central through bore 111. Lock ring 120 extends around the circumference of said central body section 112 of droppable dart 110 and has a larger outer diameter than the outer diameter of said central body section 112.

At least one flexible upper sealing fin 113 and at least one flexible lower sealing fin 114 are disposed along the length of said central body section 112 in spaced relationship. Said at least one flexible upper sealing fin 113 and said at least one flexible lower sealing fin 144 extend radially outward when exposed to fluid flow generally in direction "x", and collapse radially inward when exposed to fluid flow generally in direction "y". At least one rupture disk 115 is disposed within central through bore 111 along the length of central body member 112 and can be beneficially oriented substantially perpendicular to the longitudinal axis of central through bore 111. Said rupture disk 115 can be made of glass, ceramic or other frangible material that can be selectively broken, typically from predetermined fluid pressure or impact from another object.

Figure 5:
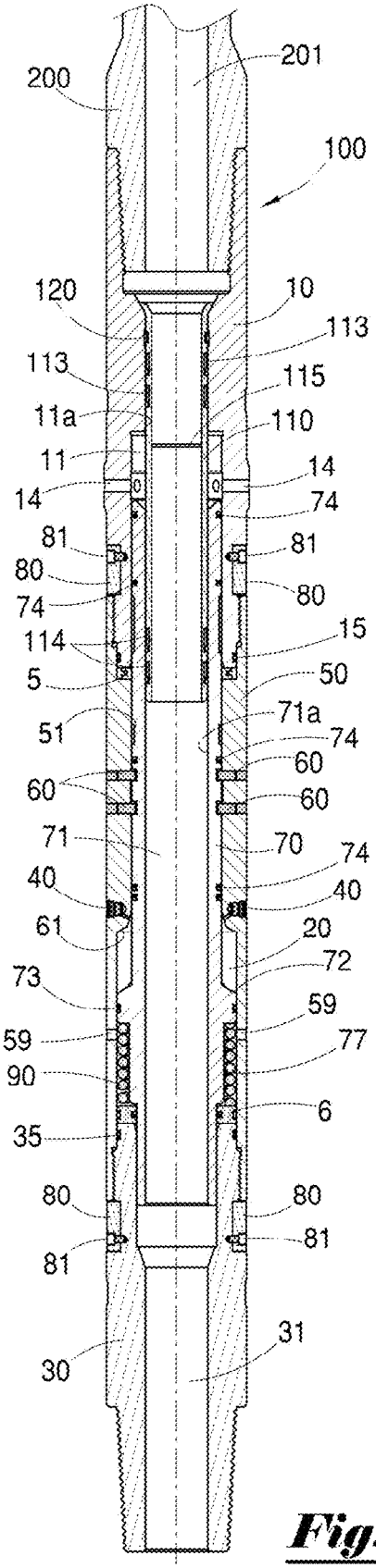
FIG. 5 depicts a side sectional view of the downhole fluid fill-up apparatus of the present invention with a droppable dart deployed.

FIG. 5 depicts a side sectional view of the downhole fluid fill-up apparatus 100 of the present invention with a droppable dart 110 deployed. In the event that sliding sleeve 70 fails to shift and/or otherwise fails to completely close transverse flow ports 14 for any reason, said droppable dart 110 can be selectively dropped or launched from the surface; droppable dart 110 can fall or be pumped downhole until it reaches downhole fill-up apparatus 100. Lock ring 120 seats within a mating recess formed along the inner surface 11*a* of central through bore 11 of upper connection member 10 and secures dart 110 against axial movement within downhole fluid fill-up apparatus 100.

Said droppable dart 110 can block or obstruct transverse flow ports 14, while upper sealing fins 113 form a fluid pressure seal against the inner surface 11*a* of central through bore 11 of upper connection member 10, and lower sealing fins 113 form a fluid pressure seal against the inner surface 71*a* of central through bore 71 of sliding sleeve 70. Rupture disk 115 can be selectively broken (by fluid pressure from pumped fluid, or from impact by another droppable object) to remove any obstruction through the central bore of said sealing dart 110. The innovative sealing design of droppable dart 110 and related mechanism ensures a secure and reliable seal, thereby preventing any undesired fluid flow through the system.

The above-described invention has a number of particular features that should preferably be employed in combination, although each is useful separately without departure from the scope of the invention. While a preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

Furthermore, the described features, structures, or characteristics may be combined in any suitable manner in one or more embodiments. In the following description, numerous specific details are provided. One skilled in the relevant art will recognize, however, that the method and/or apparatus of the present invention may be practiced without one or more of the specific details, or with other methods, components, materials, and so forth. In other instances, well-known structures, materials, or operations are not shown or described in detail to avoid obscuring aspects of the invention.

What is claimed:

1. A fluid fill-up tool, for use downhole within a wellbore comprising:

a) a housing having a central through bore and at least one communication port extending from an external surface of said housing to said central through bore;

b) a sliding sleeve movably disposed within said central through bore of said housing, wherein said sliding sleeve is configured to shift between a first open position wherein said at least communication port is open and a second closed position wherein said at least one communication port is blocked by said sliding sleeve;

c) at least one shearable member configured to secure said sliding sleeve against movement in said central through bore of said housing;

d) a fluid piston operationally attached to said sliding sleeve, wherein said housing and said fluid piston define a chamber configured to contain compressible gas on a first side of said fluid piston, and a second communication port extends from an external surface of said housing to said central through bore on a second side of said fluid piston;

wherein said at least one shearable member is configured to shear, and said sliding sleeve is configured to shift from said first open position to said second closed position, when a pressure differential across said fluid piston reaches a preset value.

2. The fluid fill-up tool of claim 1, wherein hydrostatic pressure from said wellbore is applied to said fluid piston through said second communication port.

3. The fluid fill-up tool of claim 1, further comprising:

a) a spring configured to bias said sliding sleeve from said first open position to said second closed position; and b) a floating piston ring received on said sliding sleeve, and wherein said spring is disposed between said fluid piston and said floating piston ring.

4. The fluid fill-up tool of claim 1, further comprising a droppable dart having a central bore, wherein said droppable dart is configured to be selectively received within said central through bore of said housing and block said at least one communication port.

5. The fluid fill-up tool of claim 4, wherein said droppable dart further comprises a disk disposed in said central bore of said dart, and wherein said droppable disk is configured to rupture when exposed to a predetermined fluid pressure.

6. A method for filling a downhole tool comprising:

a) providing a fluid fill-up tool comprising:

i) a housing having a central through bore and at least one communication port extending from an external surface of said housing to said central through bore;

ii) a sliding sleeve movably disposed within said central through bore of said housing, wherein said sliding sleeve is configured to shift between a first open position wherein said at least communication port is open and a second closed position wherein said at least one communication port is blocked by said sliding sleeve;

iii) at least one shearable member configured to secure said sliding sleeve against movement in said central through bore of said housing;

iv) a fluid piston operationally attached to said sliding sleeve, wherein said housing and said fluid piston define a chamber configured to contain air at atmospheric pressure on a first side of said fluid piston, and a second communication port extends from an external surface of said housing to said central through bore on a second side of said fluid piston, and wherein said at least one shearable member is configured to shear, and said sliding sleeve is configured to shift from said first open position to said second closed position, when a pressure differential across said fluid piston reaches a preset value;

b) conveying said fluid fill-up tool in a wellbore;

c) shearing said at least one shearable element in response to force acting on said fluid piston; and d) shifting said sliding sleeve from said first open position wherein said at least communication port is open to said second closed position wherein said at least one communication port is blocked by said sliding sleeve.

7. The method of claim 6, further comprising communicating hydrostatic pressure from said wellbore to said fluid piston through said second communication port.

8. The method of claim 6, wherein said fluid fill-up tool further comprises:

a) a spring configured to bias said sliding sleeve from said first open position to said second closed position; and b) a floating piston ring received on said sliding sleeve, and wherein said spring is disposed between said fluid piston and said floating piston ring.

9. The method of claim 8, further comprising pumping fluid downhole to apply force said floating piston ring to shift said sliding sleeve from said first open position to said second closed position.

10. The method of claim 6, further comprising dropping a dart having a central bore into said central through bore of said housing to block said at least one communication port with said dart if said sliding sleeve does not shift from said first open position to said second closed position.

11. The method of claim 10, wherein said droppable dart further comprises a disk disposed in said central bore of said dart.

12. The method of claim 11, further comprising rupturing said disk by applying a predetermined fluid pressure to said disk.

* * * * *